US006370821B1

(12) United States Patent
McCord et al.

(10) Patent No.: US 6,370,821 B1
(45) Date of Patent: Apr. 16, 2002

(54) FLEXIBLE GATE

(76) Inventors: David W. McCord, 13616 "W" St., Omaha, NE (US) 68137-2948; Joseph R. Pace, 818 N. 77th St., Omaha, NE (US) 68114; Joseph A. Pace, 9714 N. 72nd St., Omaha, NE (US) 68122

( * ) Notice: Subject to any disclaimer, the term of this patent is extended or adjusted under 35 U.S.C. 154(b) by 0 days.

(21) Appl. No.: 09/579,638

(22) Filed: May 26, 2000

Related U.S. Application Data

(60) Provisional application No. 60/136,254, filed on May 27, 1999.

(51) Int. Cl.[7] ..... E01F 13/00
(52) U.S. Cl. ..... 49/34; 49/9; 49/49
(58) Field of Search ..... 49/34, 49, 9

(56) References Cited

U.S. PATENT DOCUMENTS 1,628,651 A * 5/1927 Burress ..... 49/49 X
2,874,493 A * 2/1959 Mandel ..... 49/34
4,364,200 A * 12/1982 Cobb ..... 49/49 X
4,844,653 A * 7/1989 Dickinson ..... 49/34 X
5,992,800 A 11/1999 Sass ..... 246/127
6,115,963 A * 9/2000 Allardyce et al. ..... 49/49

FOREIGN PATENT DOCUMENTS

WO 94/25683 * 11/1994 ..... 49/34

* cited by examiner

*Primary Examiner*—Jerry Redman

(57) ABSTRACT

A flexible gate is disclosed which comprises a plurality of segments. The segments may be connected by at least one coupling. When the flexible gate is acted on by a force, the flexible gate may flex. When the force is no longer present, the flexible gate may return to a substantially straight position. The segments may be removed or added as needed to repair broken segments or to adjust the length of the flexible gate.

9 Claims, 9 Drawing Sheets

FLEXIBLE GATE

CROSS-REFERENCE TO RELATED APPLICATION

The present application claims the benefit under 35 U.S.C. §119 of U.S. Provisional Application Ser. No. 60/136,254 filed May 27, 1999. Said U.S. Provisional Application Ser. No. 60/136,254 is hereby incorporated by reference.

FIELD OF THE INVENTION

The present invention relates generally to the field of crossing gates and more particularly to the field of railroad crossing gates.

BACKGROUND OF THE INVENTION

Known to the art are solid, one piece gates to prevent traffic from crossing a certain area. For example, railroad crossing gates are lowered when a train is approaching to prevent traffic from crossing the railroad tracks. In another example, a gate may be used to prevent vehicles from entering a parking lot unless the customer pays a fee.

Typically, a motor is used to raise and lower a gate to stop traffic and to allow traffic to pass. However, a large motor may not be feasible for raising and lowering gates due to cost and physical size limitations. Thus, smaller motors are typically utilized with solid, light-weight gates that may be resistant to outdoor elements. For example, a number of gates are made of a solid piece of lumber, however fiberglass and aluminum have also been utilized. Unfortunately, gates made out of lumber, fiberglass, and aluminum known to the art are susceptible to damage if they come into contact with a vehicle.

Installing and maintaining a gate which is made of one solid member presents a number of problems. First of all, some gates need to be very long. For example, present highway railroad crossing gates may be as long as forty feet. Since different crossings require a different lengths of gates, a variety of sizes must be kept on hand to replace damaged gates. It may be costly to keep different sizes of gates. Additionally, it may present a storage problem due to the length of the gates. Special carriers must be installed on maintenance vehicles in order to transport gates. In order to accommodate this difficulty, some gates have been produced with two pieces of tube that telescope one inside the other. This may provide some flexibility in gate length, but results in added weight and makes it difficult to install, especially with just one maintenance person.

Damage caused when vehicles strike the gates is another problem with gates known to the art. Vehicles often strike crossing gates, usually unintentionally. Another example may involve crossing arms that are sheared off when they come down between the cab and the trailer of semi trucks. Damage to the gates costs railroad companies millions of dollars in material costs and labor costs. Also, when the gates are non-functional, the intersections become extremely dangerous for the public. For example, if a railroad crossing gate is not functional, a motorist may be unaware that a train is approaching a railroad crossing and may proceed through the intersection and subject themselves to a risk of an accident which could be prevented if the crossing gate is operational.

Some existing gates have been designed with shear pins so that the whole gate falls off when struck. While the repair person will still have to remount the crossing arm, sometimes it will not be damaged beyond use. However, the crossing arms may be run over and broken by vehicles and trains.

Consequently, it would be advantageous to provide a gate which is light-weight, capable of length adjustment, may be installed easily by a single maintenance person, and may not be damaged when vehicles inadvertently strike the gate.

SUMMARY OF THE INVENTION

Accordingly, the present invention is directed to a gate in which its length may be adjusted and one which may not be completely damaged if struck by a vehicle. Additionally, the present invention is directed to a gate which has the capability of being installed by a single maintenance person. The flexible gate of the present invention comprises a plurality of segments which may be connected by a coupling between the segments. The flexible gate may flex when acted on by a force and return to a normal straight position when the force is no longer present.

Segments may be added or removed to a gate in order to increase the length of the gate or decrease the length of the gate. Since the segments are fairly short, the segments may be carried and stored easily, and allow for easy installation or repair by a single maintenance person.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Reference will now be made in detail to a presently preferred embodiment of the invention, examples of which are illustrated in the accompanying drawings.

Figure 1:
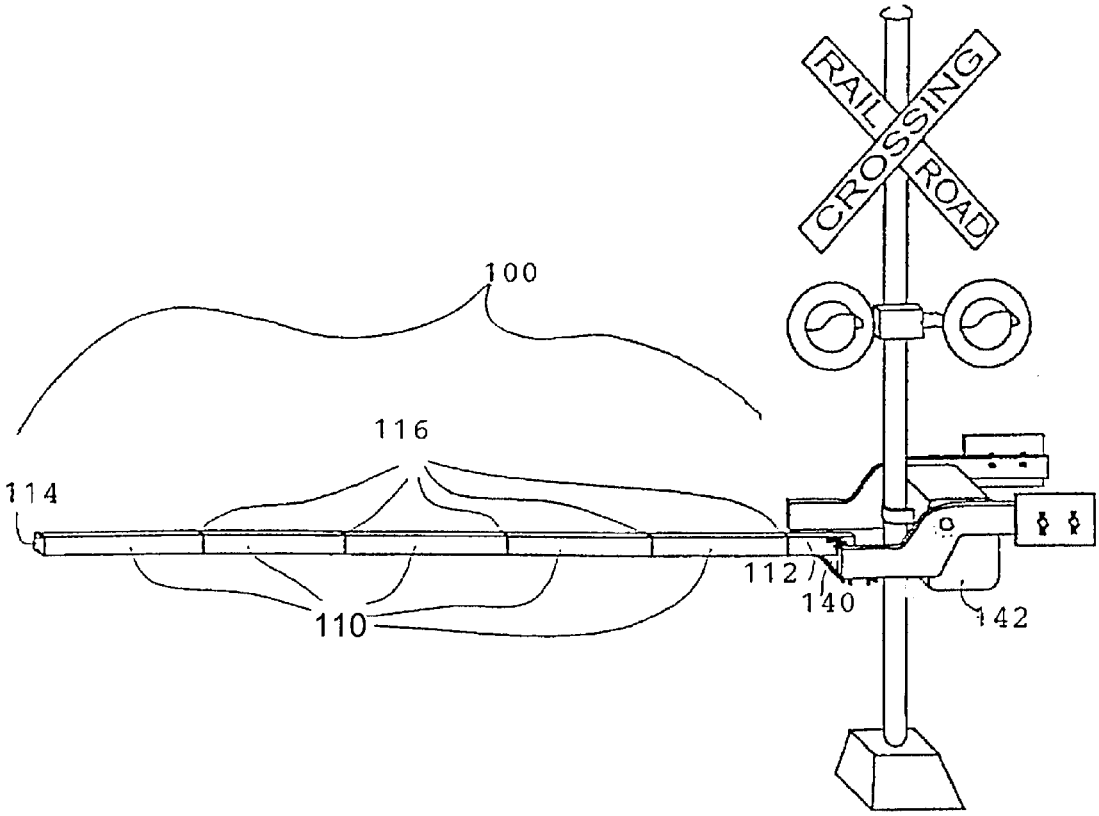
FIG. 1 is an illustration of an exemplary embodiment of a flexible gate of the present invention.

Referring now to FIG. 1, an exemplary embodiment of a flexible gate 100 in accordance with the present invention is shown. The flexible gate 100 comprises a plurality of segments 110 connected to each other by flex joints 116. A base segment 112 may be utilized at the side of the gate that may be attached to the mechanism used for raising and lowering the gate. The base segment 112 may be attached to a gate support 142 via a bracket 140.

In an exemplary embodiment, the segments may be tubes with a rectangular cross section constructed of fiberglass, aluminum or other durable material. It should be apparent to a person of ordinary skill in the art that other cross sections may be utilized for the segments as an alternative to a rectangular cross section. In a preferred embodiment, the segments may be between three feet and five feet in length. Shorter segments may be easier to store and carry than full-length gates. Additionally, different length gates may be easily constructed by using the proper number of segments. Furthermore, if a segment is damaged, the gate may be repaired by removing and replacing the damaged segment. It may be preferable to form segments in a uniform size to aid in repair and replacement. Therefore, a repair crew may carry a fewer number of segments.

Figure 2:
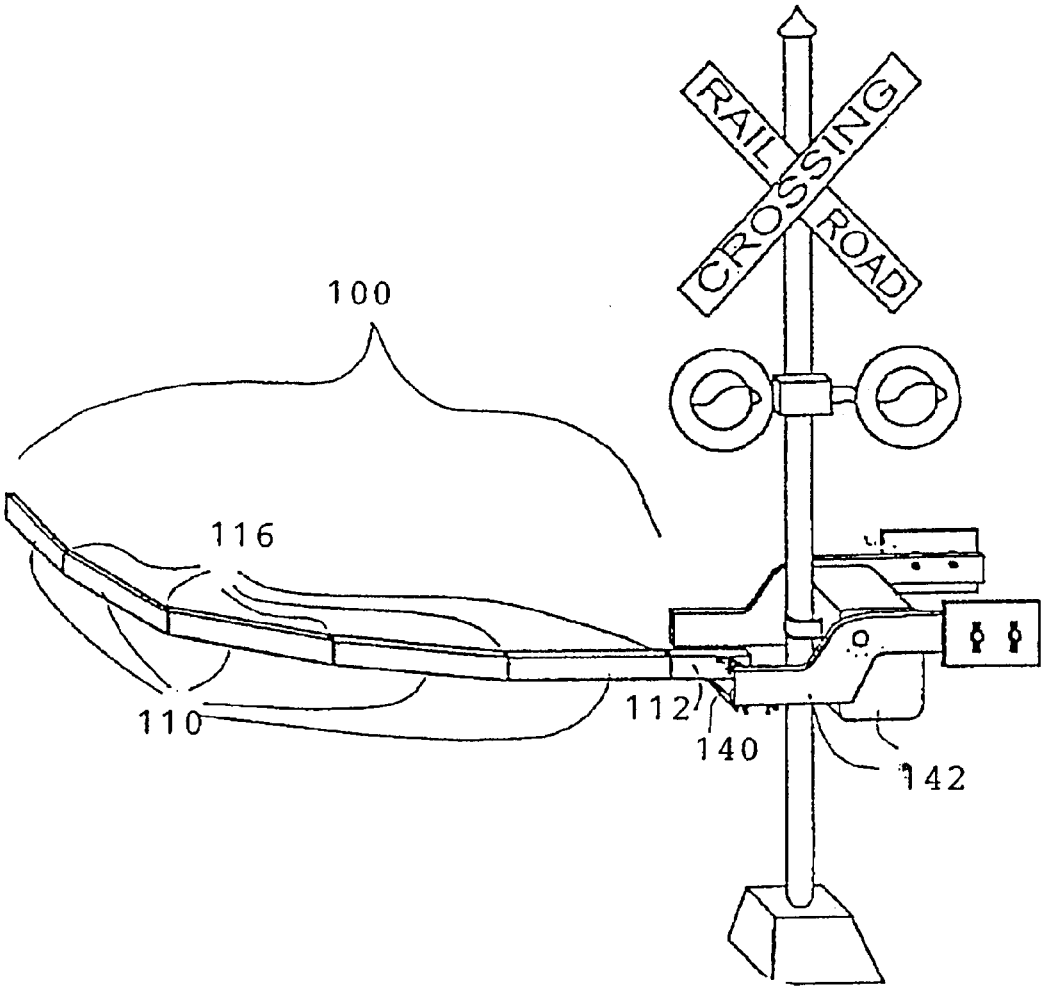
FIG. 2 is an illustration of an exemplary embodiment of a flexible gate of the present invention displaying flexible movement of the gate.

Another advantage of the present invention is the capability to withstand damage if the gate is struck. Referring to FIG. 2, an illustration of an exemplary embodiment of a gate as shown in FIG. 1 is shown displaying the capability of the gate to flexibly move in accordance with the present invention. In a preferred embodiment, a vehicle strikes a gate which may cause the gate to flex, and then return to a normal position without damaging the gate. With this embodiment, the gate may remain functional and may ensure that a railroad crossing has an adequate system to prevent traffic from crossing railroad tracks when a train is approaching.

Figure 3:
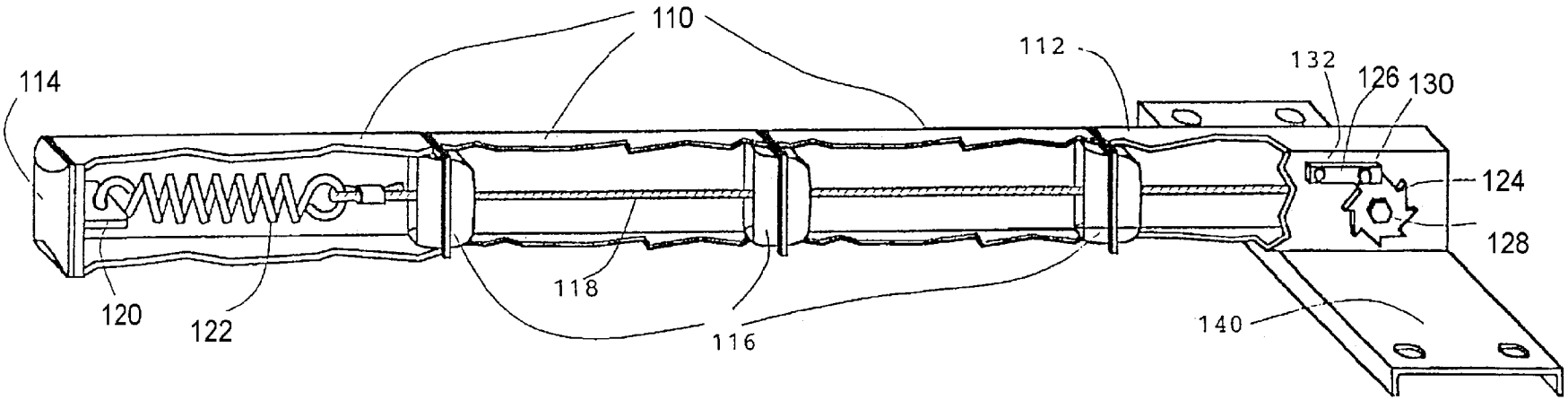
FIG. 3 is a cut-away view of an exemplary embodiment of a flexible gate.
Figure 4:
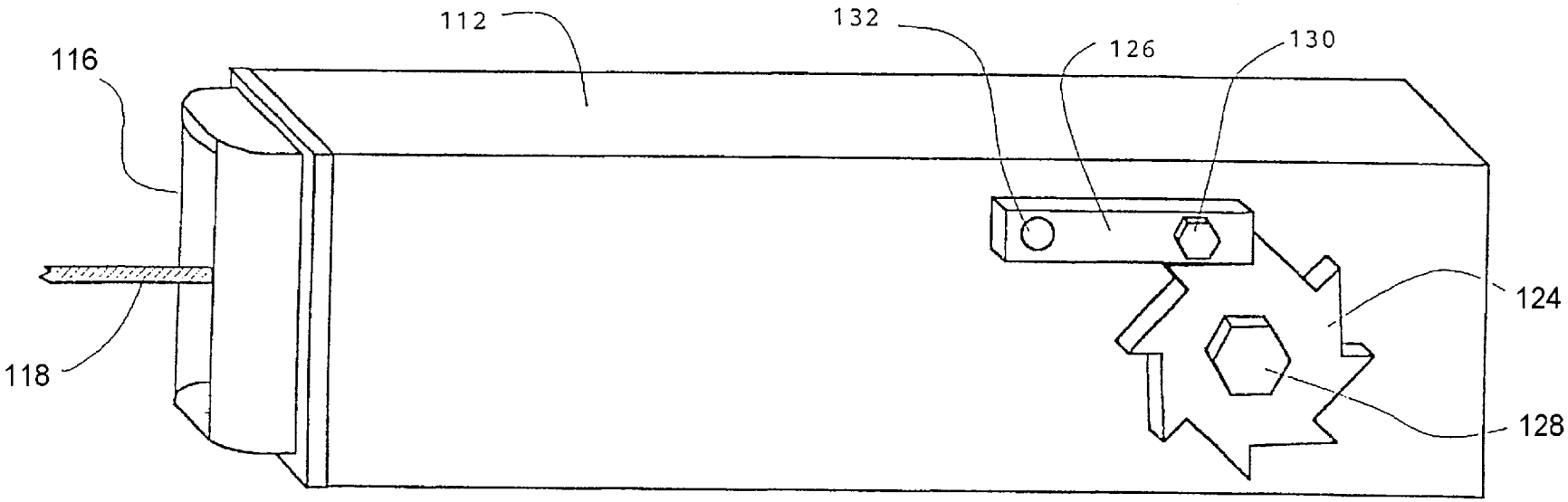
FIG. 4 illustrates an exemplary embodiment of a base segment of a flexible gate.

Referring to FIG. 3, an exemplary embodiment is shown wherein segments may be held in place by stringing a tension cable 118 from a base segment 112 to a spring 122 which is attached to an endcap 114 of a final segment via a connecting device 120. A close-up view of an exemplary base segment is shown in FIG. 4. Tension may be applied to the cable 118 by turning a hex nut 128 that is connected to the ratchet wheel 124 using a torque wrench. The pawl 126 pivots about the hinge pin 132 and prevents the ratchet wheel 124 from loosening by rotating backwards. The pawl 126 may be locked into place by inserting a bolt 130 through a hole in the pawl 126 into a threaded hole in the base segment 112.

Figure 5:
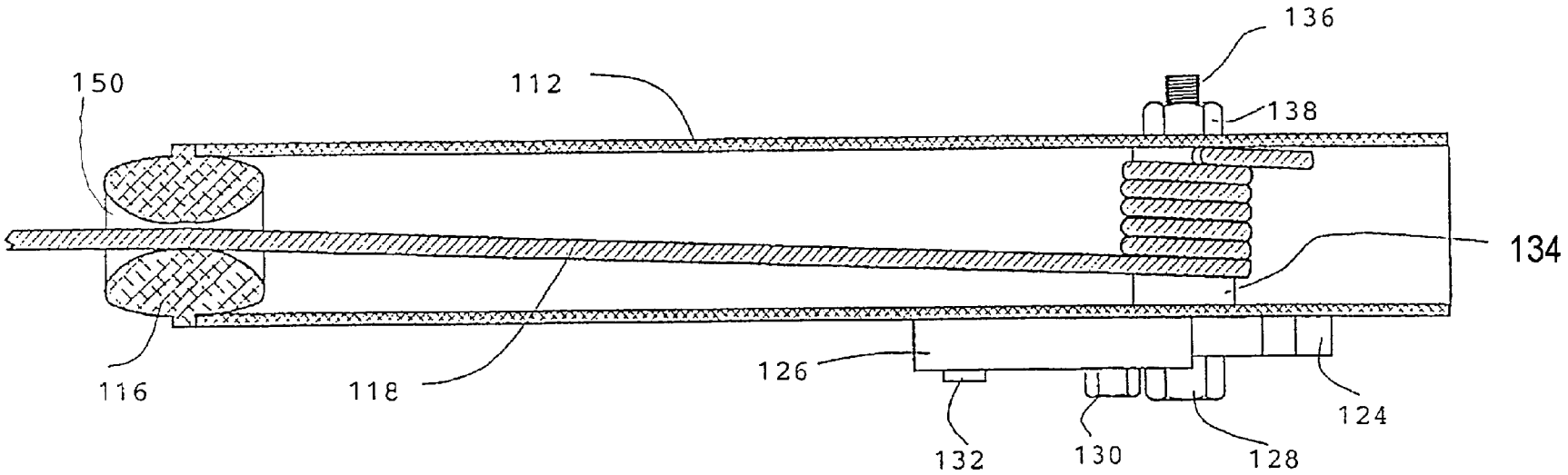
FIG. 5 is a cut-away view from the top of an exemplary base segment of a flexible gate.

A cut-away view from the top of an exemplary base segment is shown in FIG. 5. The tension cable 118 may be passed through a slot 150 in the flex joint 116 and then through a hole in the reel 134. One end of the reel 134 passes through a hole in the base segment 112 and is attached to the ratchet wheel 124. The other end of the reel 134 is connected to a threaded rod 136 that passes through the other side of the base segment 112 and has a nut 138 threaded onto the rod 136. By turning the ratchet wheel 124, the reel 134 is turned in the same direction.

Figure 6:
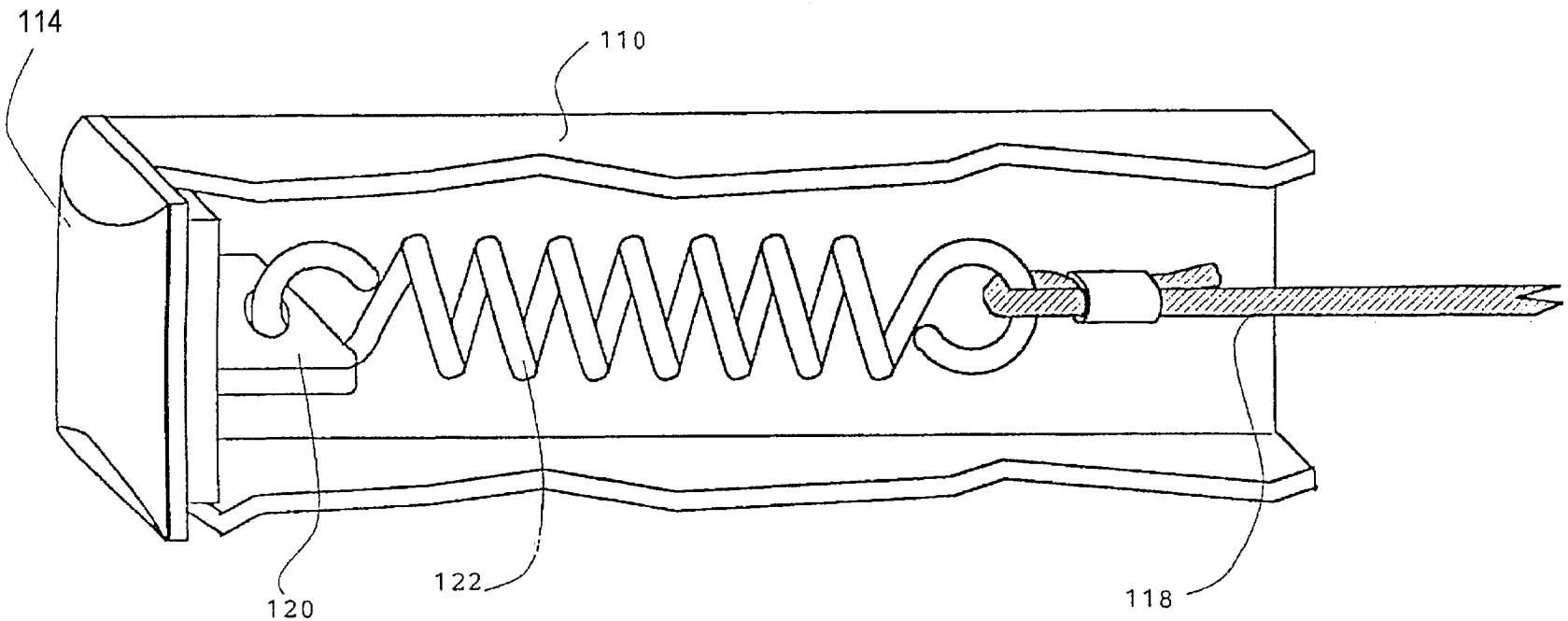
FIG. 6 is a cut-away side view of an exemplary embodiment of a segment with an endcap with an attached spring and spring mounting bracket.

Referring to FIG. 6, a cut-away view of an exemplary final segment is shown. In this embodiment, the end of the tension cable 118 may be attached to a spring 122. The spring 122 is attached to a connecting device 120 which is attached to an endcap 114 of the final segment. It should be apparent that the spring 122 may be placed anywhere in the gate without departing from the spirit and scope of the present invention.

Figure 7A:
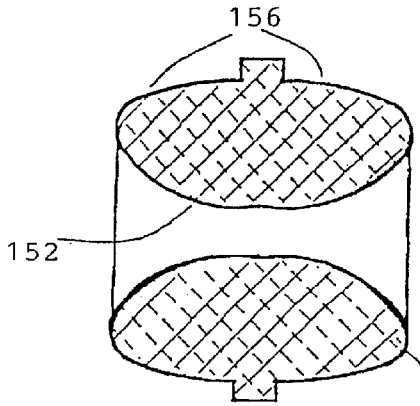
FIG. 7A is a top cut-away view of an exemplary embodiment of a flex joint.
Figure 7B:
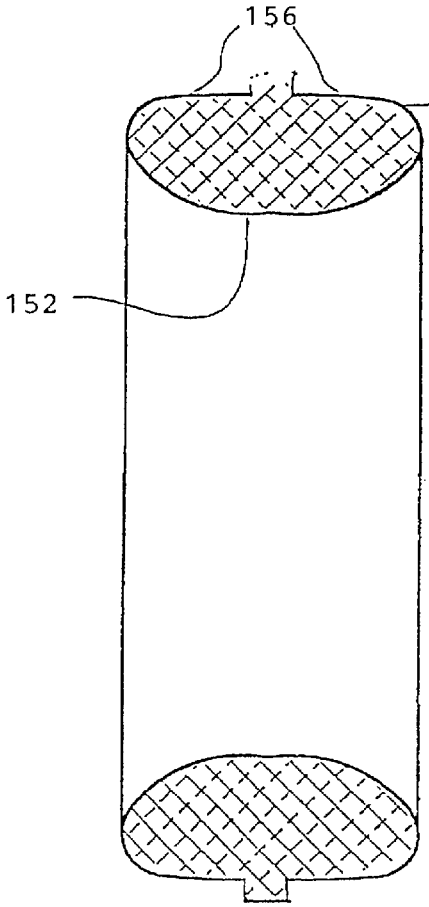
FIG. 7B is a side cut-away view of an exemplary embodiment of FIG. 7A.
Figure 7C:
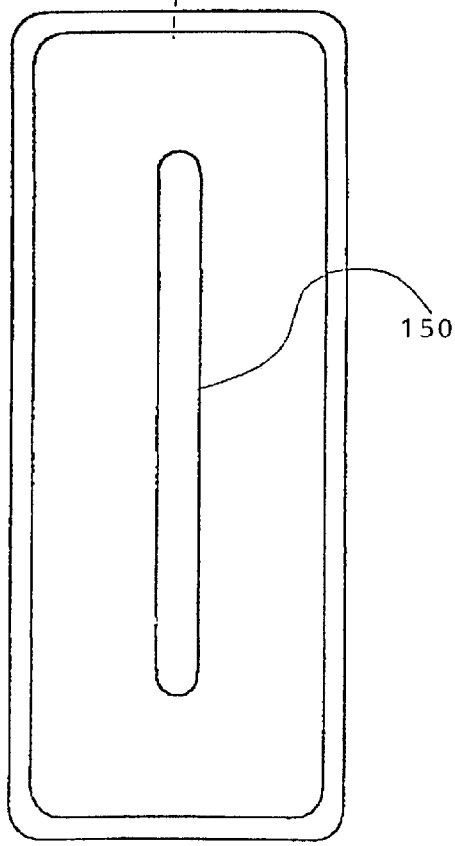
FIG. 7C is a front view of an exemplary embodiment of a flex joint which illustrates a slot in which the cable passes in an exemplary embodiment.
Figure 8:
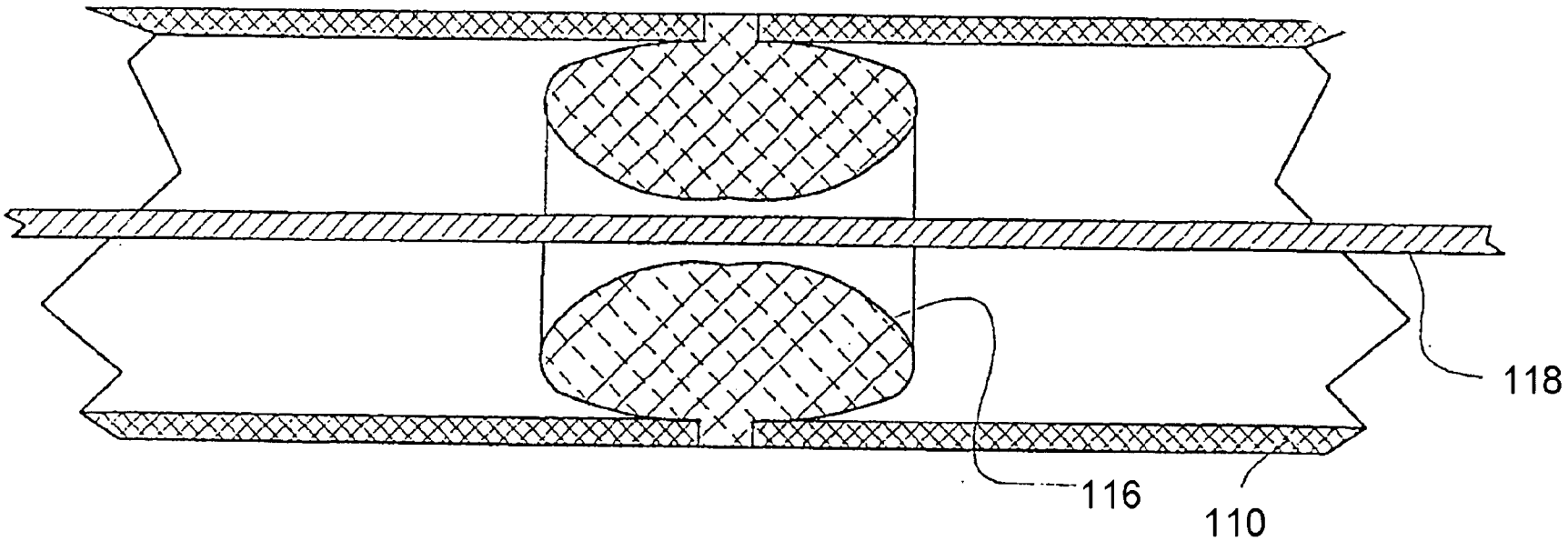
FIG. 8 is an illustration depicting a detailed cut-away of an exemplary embodiment of a flex joint between two gate segments.
Figure 9:
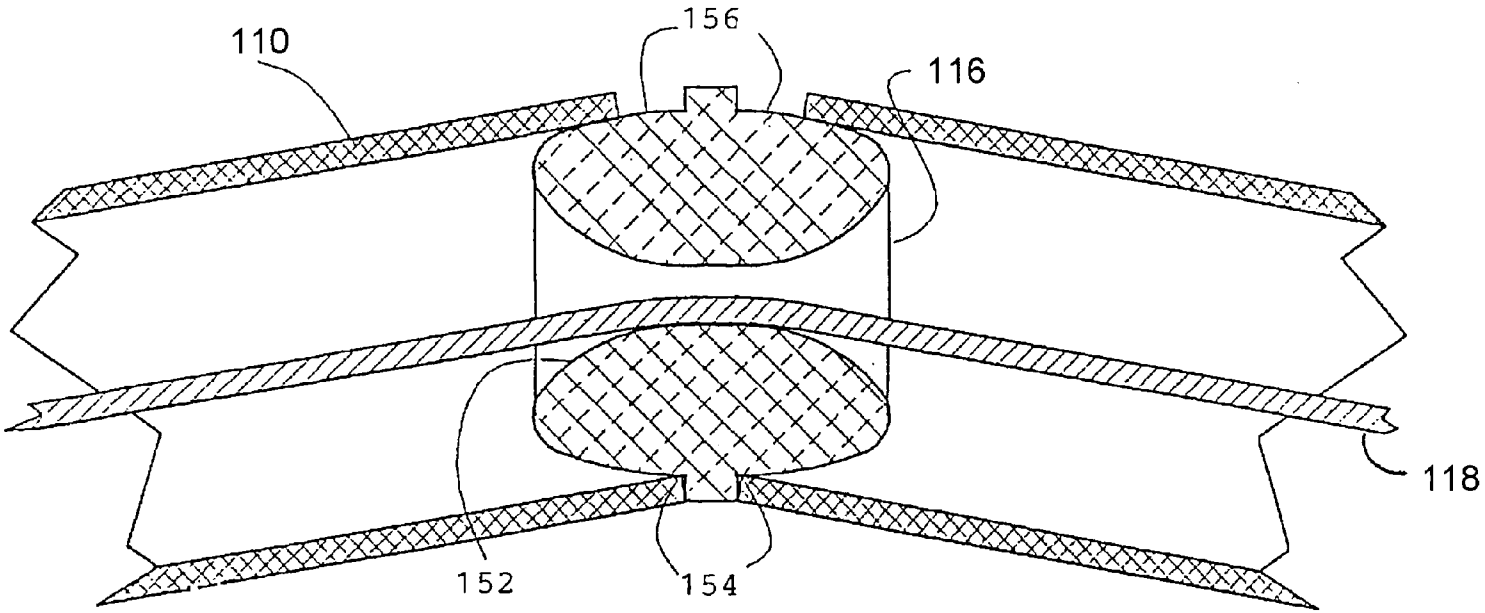
FIG. 9 is a detailed cut-away of an exemplary embodiment of a flex joint between two gate segments while the gate is in the bent position.

Turning to a more thorough explanation of an exemplary embodiment of a flex joint, cut-away views of the flex joints are shown in FIGS. 7A, 7B, and 7C. Cable 118 is passed through the slot 150 of the flex joint 116 and held centered by the inside curve 152 of the flex joint 116. Referring now to FIG. 8, a detailed view of an exemplary embodiment of the gate of the present invention in a non-flexed position is shown. When the segments 110 are pivoted about the barrier surfaces of 154 of the flex joint 110, an increase in the tension of the cable 118 results and the spring 122 is stretched as shown in FIG. 9. The surfaces 156 of the flex joint 110 may be curved on a radius such that they keep the segments 110 aligned with each other.

The tension in the cable 118 may cause the segments 110 to return to their normal straight position after bending pressure is removed. A one-way shock absorber (not shown) may be mounted in parallel with the spring to prevent the gate from swinging back too quickly after it has been bent. In another embodiment, by utilizing a different thickness and inside curvature 152 of the flex joint 110, the flexibility characteristics of the joints may be varied. For example, easily flexing joints may be used on the free end of the gate which has to support less weight and survive less wind pressure than joints at the base end of the gate.

It is believed that the present invention and many of its attendant advantages may be understood by the foregoing description, and it will be apparent that various changes may be made in the form, construction, and arrangement of the components thereof without departing from the scope and spirit of the invention or without sacrificing all of its material advantages. The form herein described being merely an explanatory embodiment thereof, it is the intention of the following claims to encompass and include such changes.

What is claimed is:

1. A flexible gate, comprising:

(a) at least two segments;

(b) a coupling connecting said at least two segments;

(c) a tension and coiling mechanism located in a segment;

(d) a spring located in a second segment;

(e) a cable connecting said tension and coiling mechanism and said spring, wherein said at least two segments are capable of flexing via movement of said at least two segments in a direction in which a force is applied, said flexible gate being capable of returning to a substantially straight position when said force is not applied.

2. The flexible gate of claim 1, wherein said at least two segments include an opening suitable for allowing a cable to pass said at least two segments.

3. The flexible gate of claim 1, wherein said flexible gate is capable of length adjustment by at least one of adding and removing segments.

4. The flexible gate of claim 1, wherein said coupling comprises:

(a) a curved side to allow a segment to rotate; and (b) a centrally disposed slot to allow said cable to pass through said coupling.

5. The flexible gate as claimed in claim 1, wherein said at least two segments are at least one of fiberglass, aluminum, and wood.

6. A flexible gate comprising:

at least two segments;

a means for connecting said at least two segments;

a mounting device suitable for attaching a flexible gate to a gate support;

a base segment including a tension and coiling mechanism suitable for connecting said flexible gate to said gate support;

a cable connecting said tension and coiling mechanism to an end of said flexible gate;

a spring connected to said cable;

a one-way shock absorber connected to said cable; and a final segment connected to said cable, wherein said flexible gate is capable of flexing via expansion of said spring and is capable of returning to a normal straight position once the force is no longer present as said spring is no longer stretched.

7. The flexible gate of claim 6, wherein said cable connects to said spring in a segment, said cable extending through said couplings and segments to said tension and coiling mechanism.

8. A flexible gate, comprising:

at least two segments;

a coupling for connecting said at least two segments;

a mounting device suitable for attaching a flexible gate to a gate support;

a base segment including a tension and coiling mechanism suitable for connecting said flexible gate to said gate support;

a cable connecting said tension and coiling mechanism to an end of said flexible gate;

a spring connected to said cable;

a one-way shock absorber connected to said cable; and a final segment connected to said cable, wherein said flexible gate is capable of flexing via expansion of said spring and is capable of returning to a normal straight position once the force is no longer present as said spring is no longer stretched.

9. The flexible gate of 8, wherein said cable connects to said spring in a segment, said cable extending through said couplings and segments to said tension and coiling mechanism.

* * * * *